US005519908A

United States Patent [19]

Steinman et al.

[11] Patent Number: 5,519,908

[45] Date of Patent: May 28, 1996

[54] CUTTING/RASPING COMBINATION TOOL

[76] Inventors: Wayne Steinman, 11529 Devin La. SE., Yelm, Wash. 98597; Thomas M. Van Eaton, P.O. Box 550, 110 Rainer Ave. North, Eatonville, Wash. 98328

[21] Appl. No.: 344,105

[22] Filed: Nov. 23, 1994

[51] Int. Cl.[6] ..... B26B 11/00

[52] U.S. Cl. ..... 7/158; 30/161

[58] Field of Search ..... 7/158; 30/138, 30/161

[56] References Cited

U.S. PATENT DOCUMENTS

| | | | |
|---|---|---|---|
| D. 360,817 | 8/1995 | Moyer, Jr. et al. . | |
| 4,274,826 | 6/1981 | Huey et al. | 7/158 X |
| 4,862,590 | 9/1989 | Winyard et al. | 30/138 X |
| 5,228,160 | 7/1993 | Porper | 7/158 |

*Primary Examiner*—James G. Smith

*Attorney, Agent, or Firm*—Graybeal Jackson Haley & Johnson

[57] ABSTRACT

The present invention provides a combination tool (21) having a knife blade (39), a rasping blade (33) and a knife blade sharpener (47) combined into a single handle member (23). Preferably, the knife blade (39) is extendable and retractable from and into the handle member (23), respectively. In the preferred embodiment, the knife blade sharpener (47) is biased upward against the knife blade (39) but fixed longitudinally. Accordingly, the knife blade sharpener (47) abrasively contacts the knife blade (39) thereby removing debris from the knife blades (39) and maintaining the knife blade (39) in a sharpened configuration. The rasping blade (33) is preferably positioned in a rasping blade housing (29) secured to the handle member (23) opposite the knife blade (39) and the knife blade sharpener (47). In operation, the user is not required to alter his or her grip when changing from cutting to rasping but merely moves the handle member (23) forward to bring the rasping blade (33) into contact with the material to be rasped.

16 Claims, 5 Drawing Sheets

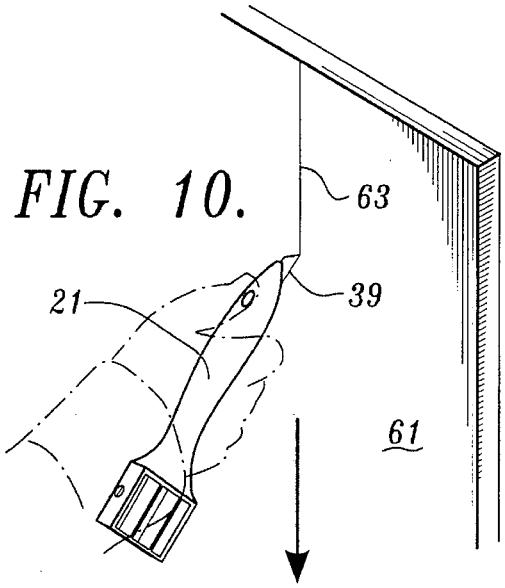
FIG. 10.
FIG. 11.
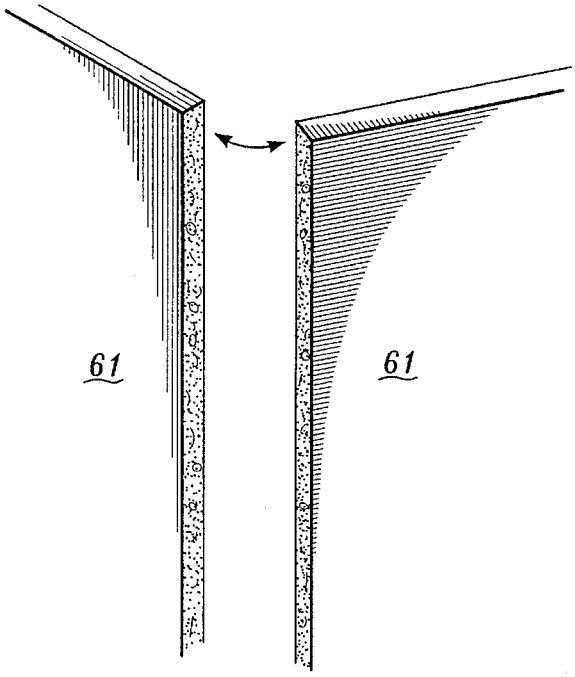
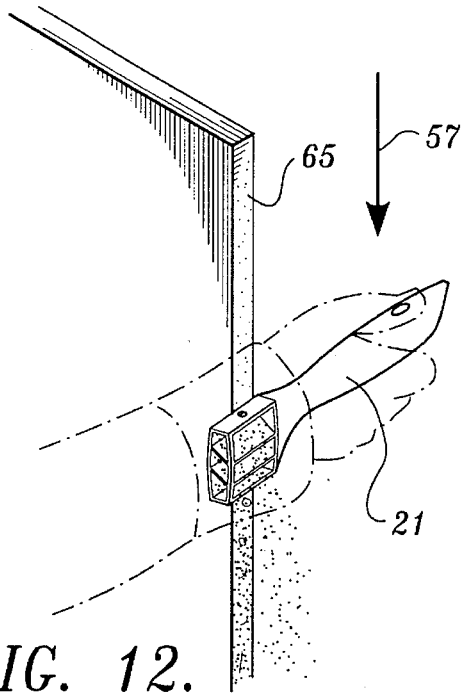
FIG. 12.

CUTTING/RASPING COMBINATION TOOL

TECHNICAL FIELD OF THE INVENTION

The present invention relates generally to tools used in the building and fabrication industry, and more specifically relates to a cutting/rasping combination tool for use in preparing sheetrock, the combination tool having a cutting knife positioned at one end of a handle member and a rasping tool positioned at an opposite end of the handle member.

BACKGROUND OF THE INVENTION

The efficiency of building, fabricating and/or remodeling a particular structure is dependant on the worker's ability to perform his or her task effectively and efficiently. This often means having the right tools readily available throughout a particular task or project. More specifically, the more the work environment can be improved, including the availability of specific tools, for safe and efficient performance by a worker, the better the final product is likely to be and the quicker it is likely to be obtained.

During the construction and/or remodeling of a particular structure, a worker (builder or fabricator) generally carries on his or her person (or keeps in close proximity to the work area) a variety of tools needed to perform and complete a specific task. These tools may be housed in compact tool boxes to be stored near the work area, or placed in larger tool cabinets readily accessible by the worker. In addition, as is very common in building construction, the tools may be carried in a tool belt worn about the worker's waist; in this regard, the tools are readily available when needed. In situations where only one or two tools may be required, the worker may simply choose to carry the tools in his or her pants pocket or coveralls to be used when needed.

To illustrate a particular construction task, one that is the topic of the present invention, a sheetrocker may carry a hammer, nails, cutting knife and/or rasping tool, all of which are generally needed to prepare and hang a single piece of sheetrock. Because a limited number of tools are required, the sheetrocker often chooses to carry these tools in a tool belt or in his or her pants pockets. During the sheetrock installation procedure, the sheetrocker will measure a section of sheetrock to be fitted to a particular area (e.g., a ceiling or a wall), score the sheetrock at the appropriate point (i.e., cut the outer sheetrock paper on at least one side of the sheetrock), break the sheetrock about the score (i.e., away from the cut) and finally cut the sheetrock paper on the opposite side of the sheetrock. Lastly, because the sheetrock is broken about the score (as opposed to being smoothly cut), there remains a jagged edge that must be rasped to properly prepare the sheetrock for installation against abutting surfaces such as other pieces of sheetrock, walls, floors and/or ceilings. In other words, the edges of the sheetrock, both cut and uncut, must closely abut one another with minimal gaps therebetween to be efficiently perfa-taped during the final finishing process. The more efficiently a sheetrocker can cut, rasp and hang the piece of sheetrock, the more expeditiously the task can be completed. This in turn reduces the overall cost and, in all likelihood, results in a higher quality final product.

Regarding the cutting and rasping procedure, a sheetrocker will generally use a conventional cutting knife to cut the outer paper of the sheetrock and a conventional rasp to smooth the jagged edges. An example of a typical cutting knife used for sheetrock preparation is shown and described in U.S. Pat. Nos. 3,107,426 to W. H. Robinson, Jr. and 3,888,002 to J. J. Graham. Such a cutting knife generally includes a handle member for being grasped by the user and a knife blade that is preferably extendable and retractable from and into the handle member. The cutting knives disclosed in these patents, while capable of being used for sheetrock preparation, may also be used for roofing, electrical wiring and/or as a general cutting knife in the building, construction and/or fabrication industries.

Another example of a cutting knife, specifically a cutting knife handle, is shown in U.S. Pat. No. 4,242,795 to E. J. Rollband et al. The Rollband et al. patent discloses a cutting knife handle having an extendable and retractable knife blade. A thumb button is provided that may be depressed to release the knife blade for either extending or retracting the knife blade from and into the handle member.

During the preparation and hanging of a piece of sheetrock, the sheetrocker, in succession, will generally use the cutting knife, the rasping tool, and the hammer and nails to complete the task of hanging a single piece of sheetrock. While the number of tools required may be minimal, misplacing a tool, leaving a needed tool behind or otherwise not having the proper tool available when needed can significantly inhibit the sheetrocker's performance, hence effecting the quality and cost of the final product. This is further complicated when the sheetrock preparation area is some distance from the sheetrock hanging area wherein the sheetrocker may waste valuable time retrieving a tool from the preparation area that is needed in the hang area and vise versa. Therefore, there is a need to minimize the number of tools a sheetrocker must carry to complete a specific task, such tools being combined or otherwise reduced in number, to minimize the probability that a tool may be left behind or otherwise not be available when needed.

Because a cutting knife, specifically the knife blade of the cutting knife, is used to cut a variety of abrasive materials including sheetrock, the knife blade may quickly become dull as a result of repeatedly cutting abrasive materials. In this regard, it may be necessary for a worker to carry replacement knife blades to replace worn or chipped knife blades. Alternatively, the worker may carry on his or her person a knife blade. sharpener used to sharpen the knife blade periodically. If the sheetrocker does not have replacement blades or a sharpener readily available, the worker may proceed to use a dull knife blade. As a result, the worker's effort in making a specific cut may increase and, as is accepted in the building industry, the worker is at a higher risk of injury when using a dull knife blade as opposed to a properly maintained knife blade. In this regard, there is a need for a relatively automatic and simple way to properly sharpen a knife blade. More specifically, there is a need for a sharpener that sharpens the knife blade as the knife blade is extended and retracted from and into the handle member.

SUMMARY OF THE INVENTION

The present invention provides a combination tool having a cutting knife, a rasping tool and a knife blade sharpener combined in a common handle member, the combination tool being readily carried by a sheetrocker to be Used as needed when preparing and hanging sheetrock. More specifically, the present invention provides a cutting knife having a conventional retractable knife blade positioned in one end of the handle member, a knife blade sharpener biased upward against the knife blade, the knife blade sharpener positioned in a forward portion of the handle member, and a rasping blade housed in a rasping blade housing attached to an end of the handle member opposite the cutting knife. The cutting knife and the rasping tool are positioned on the handle member such that the sheetrocker does not have to alter his or her grip when changing from the cutting knife to the rasping tool and vise versa. In the preferred embodiment, the sheetrocker, once the sheetrock has been scored, broken and finally cut, merely moves the handle member forward to bring the rasping blade into contact with the edge of the cut sheetrock and rasps the sheetrock edge accordingly.

The knife blade sharpener, in the preferred embodiment of the present invention, is positioned in the handle member near the end of the handle member associated with the knife blade. In this regard, the sharpener preferably remains in continuous contact with the knife blade wherein as the knife blade is extended and retracted from and into the handle member, the sharpener continually removes debris from the knife blade and simultaneously sharpens the knife blade.

The rasp portion of the combination tool includes a rasping blade housing configured to accept a conventional replaceable rasping blade (i.e., a snap-in rasping blade or a rasping blade secured to the housing with a set screw). The rasping blade housing preferably includes deflector vanes. The deflector vanes eject particles away from the edge of the sheetrock as the edge of the sheetrock is being rasped. The deflector vanes prevent sheetrock material from collecting on the floor (or cutting surface) near the edge of the sheetrock such that it becomes difficult to rasp the sheetrock edge along its entire length. In addition, the deflector vanes prevent sheetrock material from packing in behind the rasping blade thereby clogging the rasping blade.

The preferred embodiment of the present invention offsets the rasping blade housing with respect to the handle member such that, as the sheetrocker is rasping, the downward portion of the rasping blade housing contacts the floor prior to the sheetrocker's hand or knuckles contacting the floor. Further, the rasping blade housing, including the rasping blade, is configured such that the user's grip remains substantially constant as the user interchanges between using the knife blade and the rasping blade, this feature improves the efficiency of the worker and the overall quality of the final work product.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein:

FIG. 10 is a perspective view of the combination cutting/rasping tool of the present invention illustrating a user scoring and/or cutting a sheetrock panel;

FIG. 11 is a perspective view of a piece of sheetrock after the sheetrock has been scored, broken and the final outer paper cut to separate the two pieces of sheetrock; and FIG. 12 is a perspective view of the cutting/rasping tool of the present invention illustrating a user rasping a broken edge of a sheetrock panel.

DETAILED DESCRIPTION OF THE INVENTION

Figure 1:
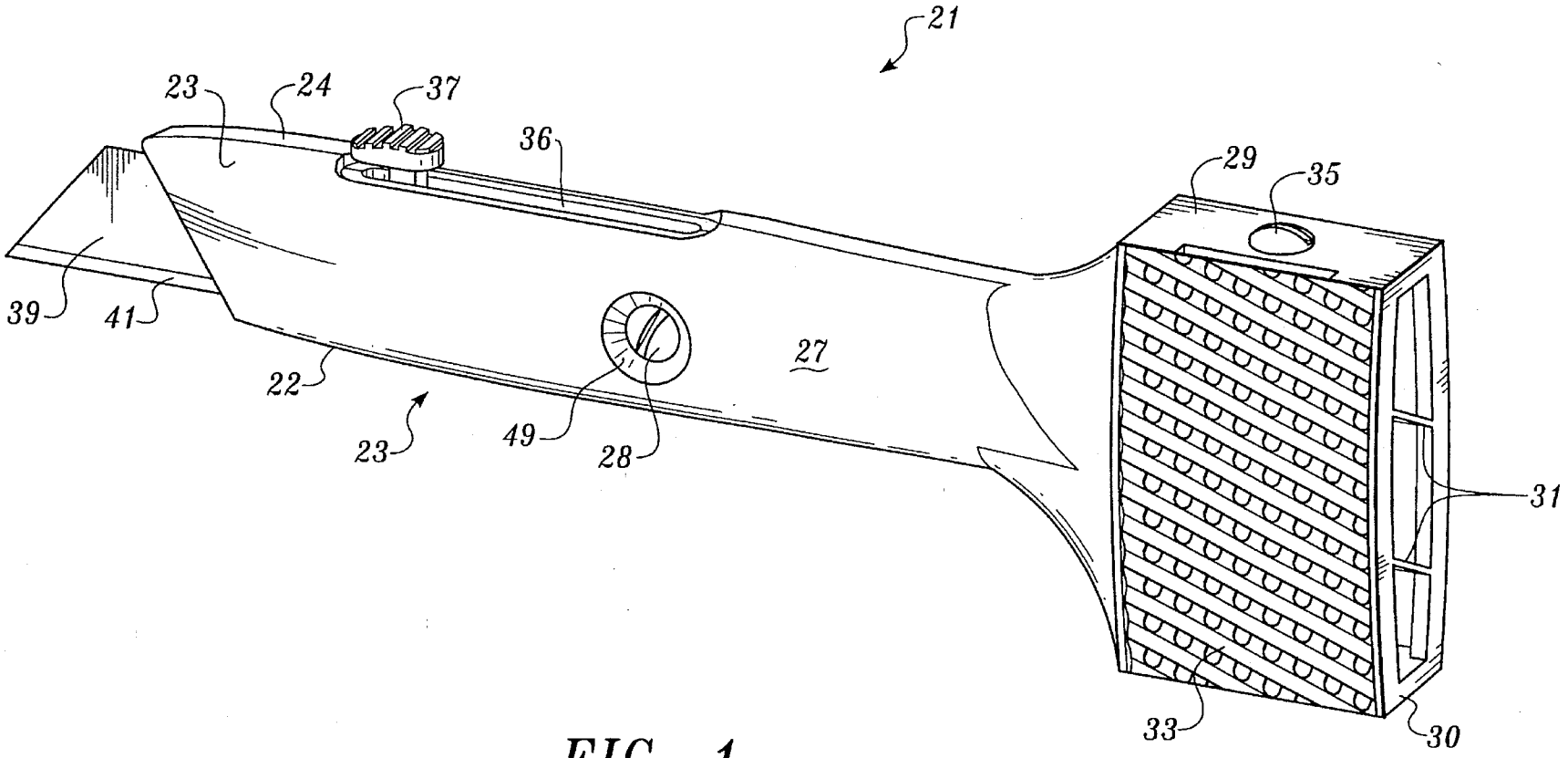
FIG. 1 is a perspective view of a combination cutting/rasping tool according to the present invention with a knife blade extended.

For purposes of describing a preferred embodiment of the combination cutting/rasping tool 21 (combination tool 21) of the present invention, the combination tool 21 will be described as it relates to the sheetrock industry, specifically cutting and rasping a piece of sheetrock for preparation of the sheetrock to be placed on a particular surface (i.e., wall or ceiling). It will be readily apparent to those skilled in the art that the combination tool 21 may be equally applicable to other work environments including, but not limited to, automotive work (i.e., body work), woodwork, plastic fabrication, etc. It is the intent of the present invention to provide a combination tool that includes both a cutting knife and a rasping tool conveniently combined into a single manageable tool.

Further, it is the intent of the present invention to improve the utility of the combination tool 21 by providing a knife blade sharpener 47 positioned within a handle member 43; this will be described in greater detail below. In this regard, it would be readily apparent to those skilled in the art that various types of sharpeners, including various sharpening abrasives, may be incorporated into the knife blade sharpener 47. It is the intent of the present invention to cover a method of sharpening and removing debris from a knife blade as a result of the knife blade being extended and retracted from and into the handle member 23.

Also, for purposes of describing the preferred embodiment of the present invention, reference will be made to a handle member lower surface 22 and a handle member upper surface 24. In this regard, the handle member lower surface 22 is that surface substantially parallel and co-linear with the knife blade-cutting edge 41. The handle member upper surface 24 is that surface associated with the upper portion of the knife blade 39, and substantially co-linear with a thumb button channel 36. Similarly, reference will be made to a rasping blade housing lower surface 30. The rasping blade housing lower surface 30 will be defined as being substantially in the same relationship with respect to the handle member 13 as the handle member lower surface 22 is with respect to the handle member 23.

Referring now to FIG. 1, there is shown the combination tool 21 of the present invention having a handle member 23, a knife blade 39, and a rasping blade 33. The knife blade 39 is preferably extendable and retractable from and into the handle member 23 using a thumb button release 37. The thumb button release 37 is preferably longitudinally moveable within a thumb button channel 36 from a forward position (shown in FIG. 1 wherein the knife blade 39 is extended) to a rearward position (shown in FIGS. 8 and 9 wherein the knife blade 39 is retracted into the handle member 23).

Figure 2:
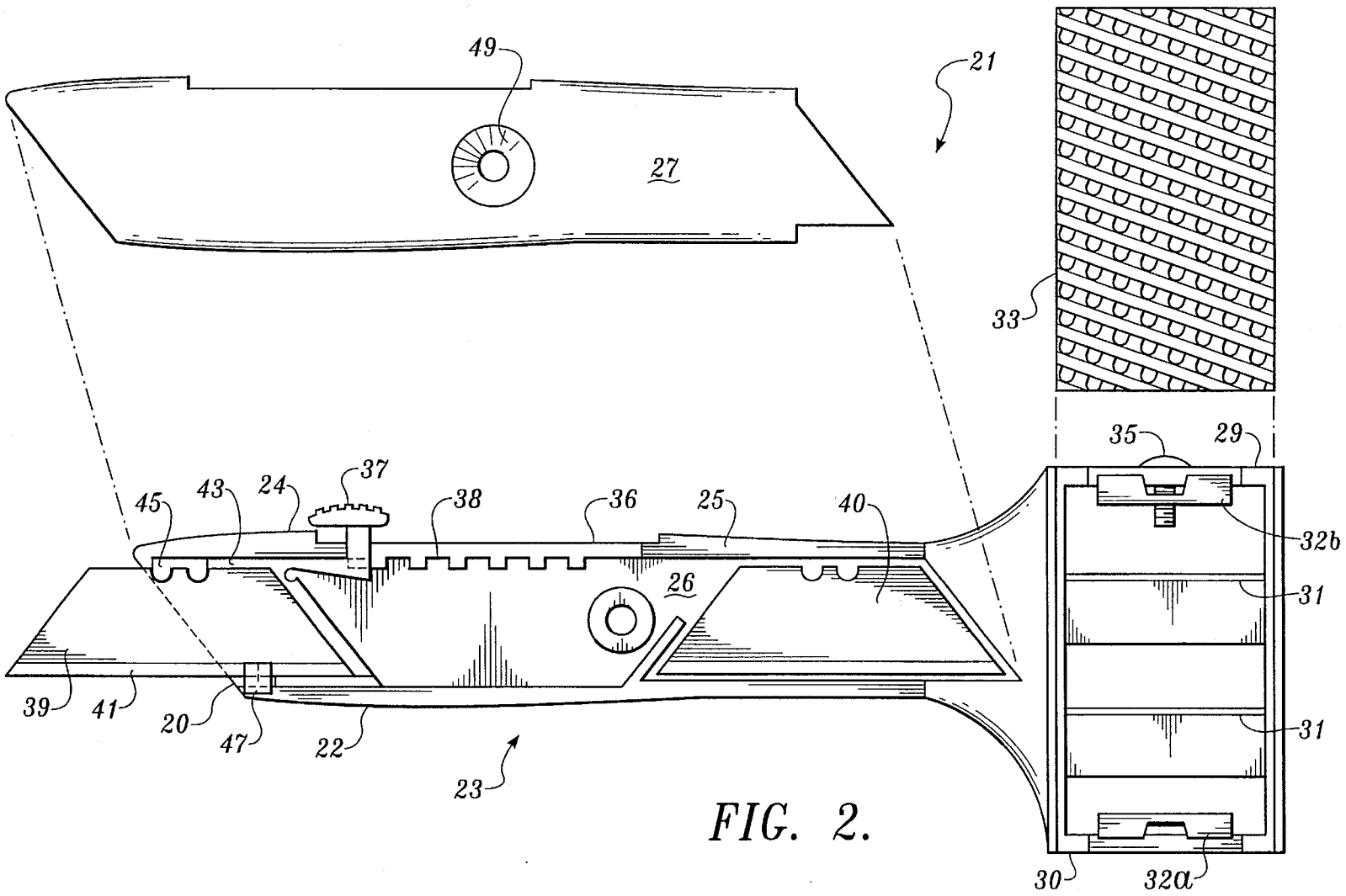
FIG. 2 is an elevational partially exploded side view of the combination cutting/rasping tool of the present invention with a handle member cover and a rasping blade exploded away exposing a knife blade sharpener, deflector vanes and an interior storage compartment of the handle member.

In the preferred embodiment of the present invention, the handle member 23 includes a handle member cover 27 that is preferably removable; this is shown in FIG. 2. The handle member cover 27 provides access to the knife blade 39 for replacement of the knife blade 39 and also for exposing a storage compartment 26 where replacement blades 40 may be stored for subsequent use. The handle member cover 27 is preferably secured in place using a set screw 28; preferably the set screw 28, when secured in place, is flush with the outer surface of the handle member 23 by way of a recess 49.

Also shown in FIG. 2, the knife blade 39 rides in a knife blade carrier 43. The knife blade carrier 43 includes knife blade locking nubs 45. The knife blade locking nubs 45 and the knife blade carrier 43 are secured to the thumb button 37 which rides in the thumb button channel 36. The thumb button channel 36 includes on its undersurface thumb button locks 38. The knife blade carrier 43 applies a continually upward biasing force on the thumb button 37 holding the thumb button in a locking relationship with respect to the thumb button locks, hence the handle member 23. When the thumb button 37 is pushed in a substantially downward direction, the thumb button is released from the thumb button locks wherein the thumb button 37, along with the knife blade carrier 43 and the knife blade 39, can be moved longitudinally within the thumb button channel 36, hence longitudinally along the handle member 23. When the thumb button 37 is released, the thumb button 37 locks in place within the thumb button locks 38.

While the preferred embodiment of the present invention includes an extendable and retractable knife blade 39, it will be readily apparent to those skilled in the art that the knife blade 39 may be fixed in position relative to the handle member 23 and may not necessarily include the removable cover 27. In this regard, the thumb button 37, the thumb button channel 36 and the knife blade sharpener would not be necessary feature. This particular configuration—wherein the knife blade 39 is fixed—may be useful in providing a relatively inexpensive lightweight combination tool 21 that is relatively inexpensive to manufacture. However, this type of combination tool would still be considered to fall within the purview of the present invention wherein it included a knife blade and a rasping blade combined into a substantially single tool.

Figure 6:
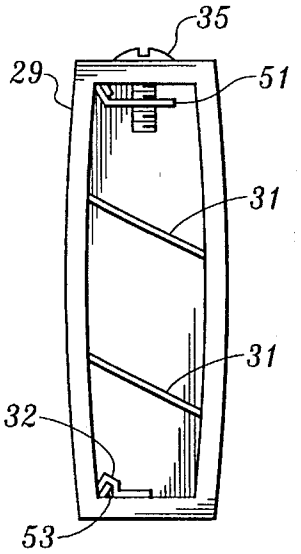
FIG. 6 is an elevational end view of FIG. 5 illustrating the preferred configuration of the end portion of the rasping blade housing.
Figure 5:
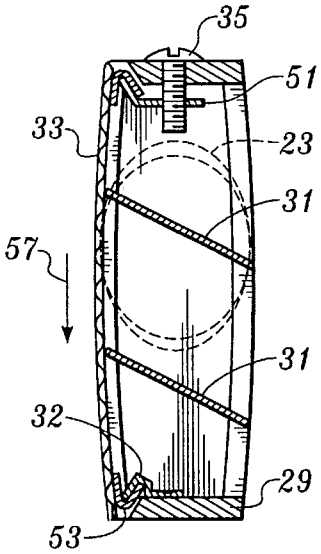
FIG. 5 is an elevational partial cross sectional end view of the combination cutting/rasping tool of the present invention viewed from the rasping blade housing end illustrating the preferred configuration of deflector vanes positioned in the rasping blade housing.

At an end of the handle member 23, preferably opposite the knife blade 39, the present invention provides a rasping blade housing 29. The rasp blade housing 29 is preferably configured to accept a conventional rasping blade 33, however it will be readily apparent to those skilled in the art that the rasping blade housing 33 may be configured to accept multiple sizes, shapes and makes of rasping blades. The rasping blade 33, is preferably secured in place within the rasping blade housing 29 using a rasping blade set screw 35. More specifically, there are provided lower and upper rasping blade retention locks, **32*a* and 32*b* respectively. The rasp blade is positioned over the lower rasp blade retention lock 32*a* and snapped into place over the upper rasp blade retention lock 32*b*. Subsequently, the set screw 35 Can be inserted into and secured to a tab 51 of the blade 33 to securely hold the rasping blade 33 in place (this is also shown in FIGS. 5 and 6). While the preferred embodiment of the present invention is described with respect to the replaceable rasping blade 33, it will be readily appreciated by those skilled in the art that various types of rasping blades are equally applicable to the rasping blade housing 29 including a non-replaceable rasping blade. Specifically, a permanent rasping blade may be molded into the rasping blade housing 29** during manufacture which again may be particularly applicable to a disposable combination tool.

The rasp blade housing 29 includes rasping blade deflector vanes 31 for ejecting loose particles broken away from the sheetrock as a result of the rasping operation. The deflection of particles away from the sheetrock prevents the rasping blade 33 from becoming clogged, and further, ejection of particles away from the edge of the sheetrock prevents sheetrock material from collecting on the floor or cutting surface near the edge of the sheetrock such that it becomes difficult to rasp the sheetrock edge along its entire length.

Referring now to FIG. 2, there is shown a partially exploded view of the preferred embodiment of the present invention. More specifically, the combination tool 21 is shown with the handle member cover 27 exploded away from the handle member 23. In this regard, FIG. 2 shows a substantially conventional configuration for a cutting knife having a knife blade 39 that is extendable and retractable using the thumb button 37. FIG. 2 similarly shows the storage compartment for housing additional replacement blades 40.

With the handle member cover 27 removed, the knife blade sharpener 47 is similarly exposed. The knife blade sharpener 47 is preferable positioned in close proximity to the handle member lower surface 22 near a front portion 20 of the handle member 23. In the preferred embodiment, the knife blade 39 is extendable and retractable from and into the handle member 23. In this regard, the knife blade cutting edge 41 remains in constant contact with the knife blade sharp net 47. As the knife blade 39 is extended and retracted from and into the handle member 23, the knife blade sharpener 47 continually removes debris from the knife blade 39, specifically the knife blade cutting edge 41 and simultaneously sharpens the knife blade cutting edge 41. This is particularly applicable where, as is common in the sheetrock industry, the knife blade 39 is used to cut abrasive materials that will quickly dull the knife blade cutting edge 41. The knife blade sharpener 47 extends the useful life of the knife blade 39 by continually sharpening the knife blade cutting edge 41 with each extension and retraction of the knife blade 39.

The knife blade sharpener 47 of the present invention is equally applicable to cutting knives which do not necessarily incorporate the rasping blade feature of the present invention. More specifically, the knife blade sharpener 47 may be beneficial whenever a knife blade becomes quickly contaminated with materials that dull the knife blade cutting edge 41 or wherein the cutting knife is being used to cut abrasive materials. In this regard, the knife blade sharpener 47 will remove debris thereby improving the useful life of the knife blade 39. It will be readily apparent to those skilled in the art how the knife blade sharpener 47 may be incorporated into various cutting knives.

Figure 7:
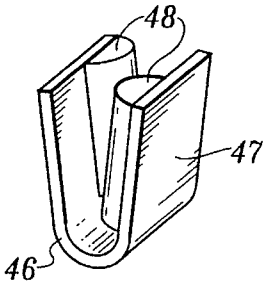
FIG. 7 is a perspective view of a preferred embodiment of a knife blade sharpener used to remove debris and perpetually sharpen the knife blade of the combination cutting/rasping tool of the present invention.

Referring now to FIG. 7, there is shown in greater detail the knife blade sharpener 47. In the preferred embodiment of the present invention, the knife blade sharpener 47 includes a u-shaped support structure 46. The support structure 46. has attached to opposing inner surfaces of the support structure 46, sharpening stones 48. The sharpening stones 48 are offset from one another such that a "V" is formed at the intersection of the sharpening stones 48 when viewed such that the U-shaped configuration of the support structure 46 is clearly visible. More specifically, the sharpening stones 48 form a "V" in which the knife blade cutting edge 41 rests as the cutting blade 39 is extended and retracted from and into the handle member 23. Preferably, the knife blade sharpener 47 is biased in a substantially upward direction by a spring (not shown) such that the sharpening stones 48 remain in constant contact with the knife blade cutting edge 41. It will be readily determinable by reasonable experimentation the pressure the knife blade sharpener 47 should apply against the knife blade 39. Regardless, it is important that the pressure be balanced such that excess pressure is avoided that would unduly wear the knife blade 39 and that minimal pressure is avoided that would be ineffective in properly cleaning debris from the knife blade cutting edge 41 and sharpening the knife blade cutting edge 41.

It will be readily apparent to those skilled in the art that various types of sharpening stones and configurations for mounting the stones to maintain the integrity of the knife blade cutting edge 41 may be used. The present invention purports to protect the use of any type of sharpening stone or debris removing apparatus which works in conjunction with the extension and retraction of the knife blade 39.

Figure 3:
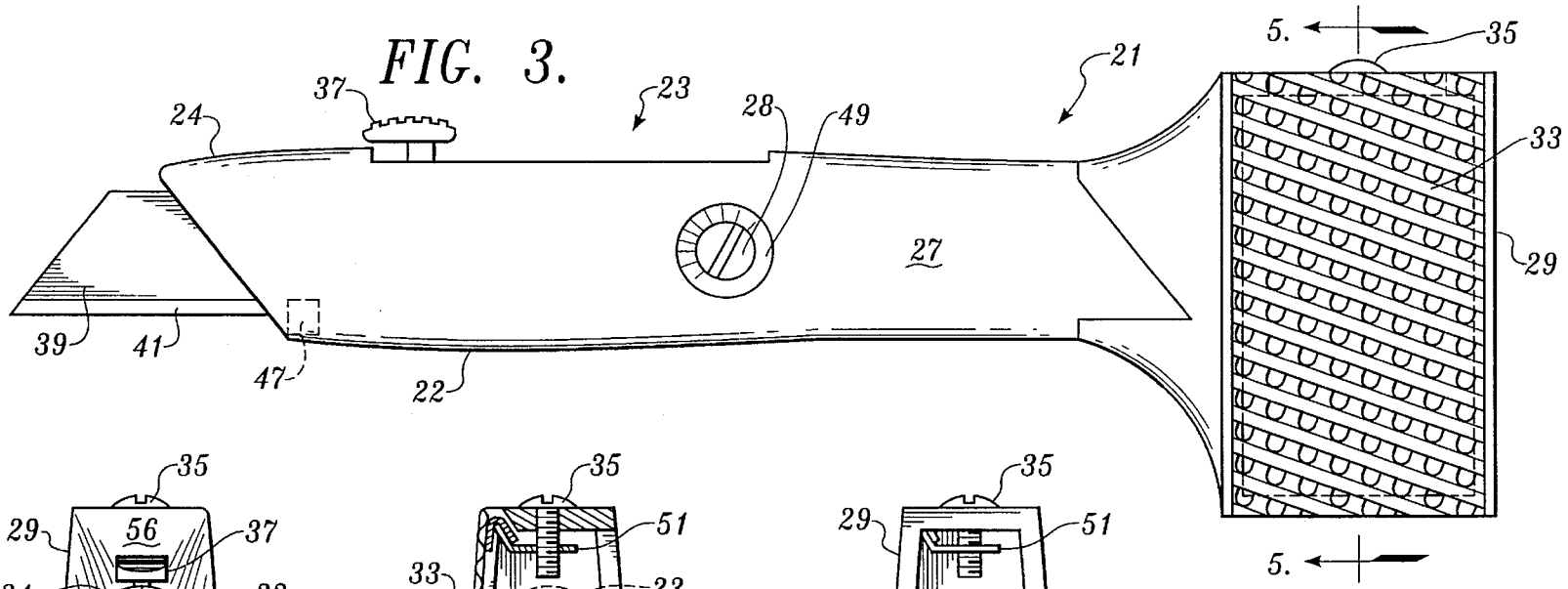
FIG. 3 is an elevational side view of the combination cutting/rasping tool shown in FIG. 2 with the handle member cover and the rasping blade installed.
Figure 8:
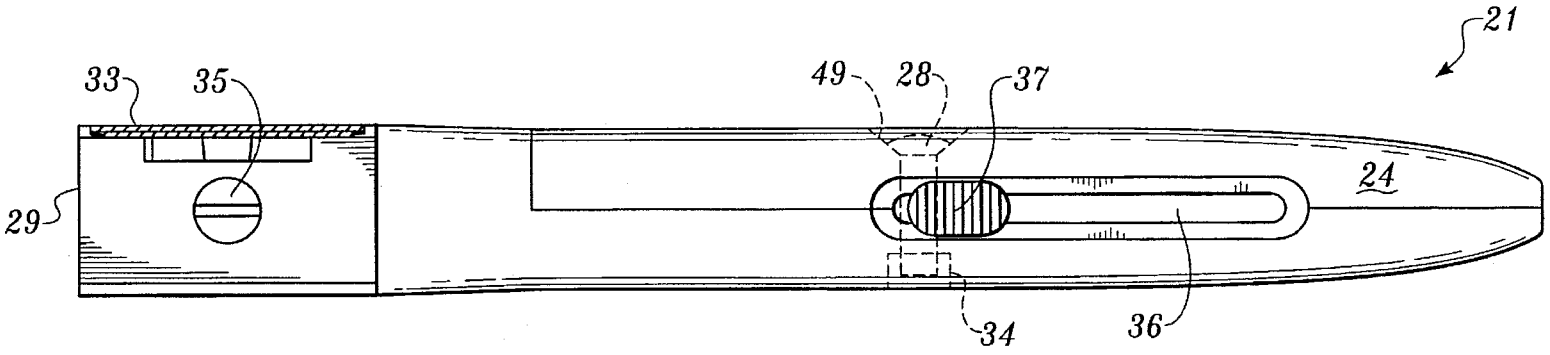
FIGS. 8 and 9 are elevational top and side views respectively of the combination cutting/rasping tool of the present invention with the knife blade retracted, FIG. 9 showing the deflector vanes positioned on the back side of the rasping blade.
Figure 9:
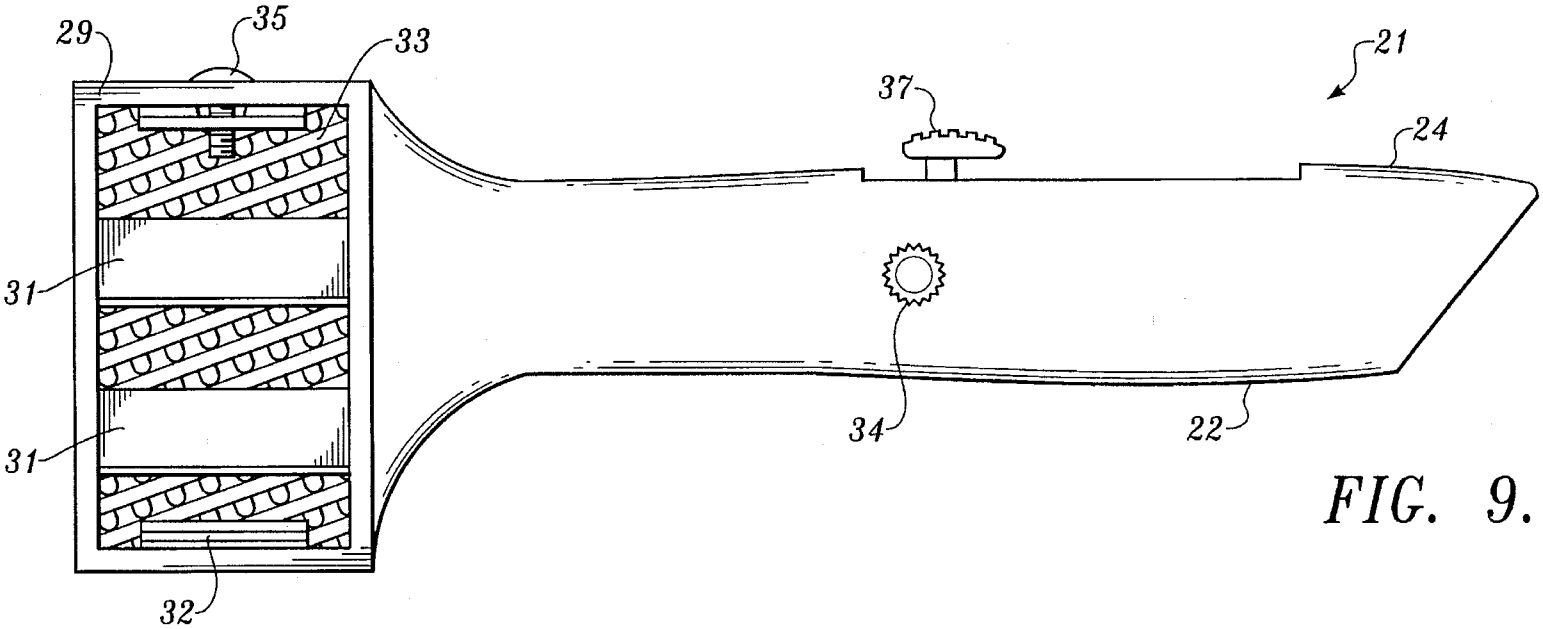

Referring now to FIGS. 3, 8 and 9, there is shown the combination tool 21 of FIG. 2 with the handle member cover 27 securely in place and the rasping blade 33 secured within the rasping blade housing 29. FIG. 3 shows the combination tool 21 of the present invention in a cutting configuration, or otherwise with the knife blade 33 extended. FIGS. 8 and 9 show the combination tool 21 in preferred storage configuration or in a configurations that would be the preferred safe configuration for rasping a piece of sheetrock, i.e., the knife blade is retracted. FIG. 8 shows the thumb button 37 positioned within the thumb button channel 36. In this regard, the thumb button 37 is longitudinally movable within the thumb button channel 36 from a forward most position wherein the knife blade 39 is entirely extended to a rearward position wherein the knife blade 33 is entirely retracted.

FIG. 9 shows the relationship of the deflector vanes 31 positioned within the rasping blade housing 19 behind the rasping blade 33. Preferably, the deflector vanes 31 are contained substantially within the rasping blade housing 29 thereby being protected from damage that may result by the combination tool 21 being dropped or otherwise abused.

Figure 4:
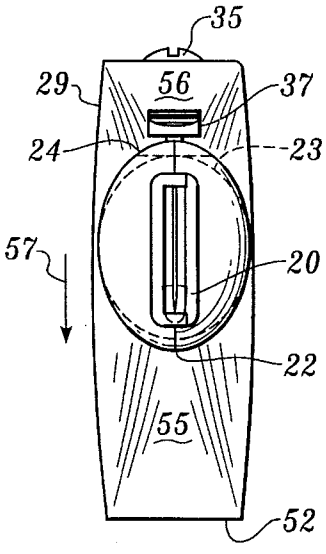
FIG. 4 is an elevational end view of the combination cutting/rasping tool of the present invention viewed from the knife blade end illustrating a preferred configuration of the rasping blade housing.

FIGS. 4 through 6 show various perspectives of the preferred embodiment of the rasping housing of the combination tool of the present invention. More specifically, FIG. 4 shows the combination tool 21 of the present invention as viewed from the handle member front 20. In this regard, it can be readily seen that the rasping blade housing 29 is asymmetric about the handle member 23. More specifically, the rasping blade housing 29 has a lower portion 55 that extends significantly below the handle member lower surface 22. Similarly, but to a lesser degree, the upper portion 56 of the rasping blade housing 29 extend above the handle member upper surface 24. This particular configuration of the combination tool 21 provides sufficient surface area:to secure the rasping blade 33, and also insures that when material is being rasped in the direction of the arrow 57, the worker's hand, specifically the worker's knuckles, will not contact the resting surface (presumably the floor) prior to the lower surface 52 of the rasping blade housing 29 contacting the lower surface; this feature protect the worker's hands.

FIG. 5 shows a cross-sectional view along line 5—5 of FIG. 3 showing the rasping blade housing 29. The rasping blade 33 is positioned on one side of the rasping blade housing 29 with the rasping blade deflector vanes 31 positioned behind but within the rasping blade housing 29. As the rasping blade housing 29 is moved in the direction of the arrow 57, which would correspond to the "cutting" direction of the rasping blade 33, particles removed from the edge of the sheetrock are ejected through the rasping blade 33 thereby contacting the deflector vanes 31. In this regard, the deflector vanes 31 direct particles downward and outward away from the edge of the sheetrock. FIG. 6 shows the entire assembled combination tool 21 wherein the rasping blade housing 29 completely surrounds and protects both the rasping blade 33 and the deflector vanes 31.

In operation, the worker preferably extends the knife blade 39 using the thumb button 37 to a cutting position as shown in FIG. 3. The worker then scores or cuts the outer paper of the sheetrock 61 as shown in FIG. 10. The worker then breaks the sheetrock away from the score 63 and subsequently cuts the opposite protective paper of the sheetrock 61 (FIG. 11). The worker then retracts the knife blade 39 using the thumb button 37, moves the handle member 23 forward until the rasping blade housing 29 is positioned over the broken edge 65 and moves the rasping blade housing 29 up and down thereby rasping the edge of the sheetrock with the rasping blade 33; this is shown in FIG. 12. This preferred usage of the combination tool 21 does not require the worker to alter his or her grip between cutting and/or scoring the sheetrock 61 and rasping the sheetrock 61. It will be appreciated by those skilled in the art that the combination tool 21 may be configured for left-handed or right-handed use or may be configured to be readily and quickly converted from one to the other.

While the preferred embodiment of the present invention has been illustrated and described in detail, it will be appreciated that various changes can be made without departing from the spirit and the scope of the invention.

The embodiments of the present invention in which an exclusive property or privilege is claimed are defined as follows:

1. A combination tool for cutting and rasping, comprising:

a. a handle member configured to be securely grasped by a user, the handle member having a first cutting end, and a second rasping end, the first cutting end and the second rasping end being positioned opposite one another at either end of the handle member;

b. a cutter secured to the first cutting end of the handle member, the cutter being used for scoring and cutting material; and c. a rasp secured to the second rasping end of the handle member, the rasp being used for smoothing, filing and finishing material.

2. The combination tool of claim 1, wherein the handle member further includes an elongated central channel within the handle member, wherein the cutter secured to the first cutting end of the handle member is movable within the elongated central channel from a retracted position wherein the cutter is substantially concealed within the handle member, to an extended position wherein the cutter protrudes from the first cutting end of the handle member.

3. The combination tool of claim 2, wherein a cutter sharpener is positioned within the handle member near the first cutting end of the handle member, the cutter sharpener being substantially longitudinally fixed wherein as the cutter is extended and retracted from and into the handle member, the cutter sharpener abrasively contacts the cutter.

4. The combination tool of claim 3, wherein the cutter sharpener is upward biased against the cutter thereby causing the cutter sharpener to be in continuous contact with the cutter as the cutter is extended and retracted from and into the handle member, the contact between the cutter and the cutter sharpener maintaining the cutter in a substantially sharpened configuration.

5. The combination tool of claim 1, wherein the rasp includes a rasp housing secured to the second rasping end of the handle member.

6. The combination tool of claim 5, wherein the rasp housing includes vanes for deflecting particles removed by the rasp away from the rasp housing, the vanes being positioned substantially behind the rasp and affixed to the rasp housing.

7. The combination tool of claim 5, wherein the rasp housing is asymmetric about the handle member, the rasp housing extending below the handle member a distance greater than the distance that the rasp housing extends above the handle member, the extension of the rasp housing below the handle member protecting the user's hands.

8. A combination tool for cutting and rasping, comprising:

a. a handle member configured to be securely grasped by a user, the handle member having a first cutting end, and a second rasping end, the first cutting end and the second rasping end being positioned opposite one another at either end of the handle member;

b. a cutter secured to the first cutting end of the handle member, the cutter being used for scoring and cutting material;

c. a rasp secured to the second rasping end of the handle member, the rasp being used for smoothing, filing and finishing materials; and d. a cutter sharpener positioned within the handle member near the first cutting end of the handle member, the cutter sharpener being substantially longitudinally fixed wherein as the cutter is extended and retracted from and into the handle member, the cutter sharpener abrasively contacts the cutter.

9. The combination tool of claim 8, wherein the handle member further includes an elongated central channel within the handle member, wherein the cutter secured to the first cutting end of the handle member is moveable within a elongated central channel from a retracted position wherein the cutter is substantially concealed within the handle member, to an extended position wherein the cutter protrudes from the first cutting end of the handle member.

10. The cutter sharpener of claim 9 wherein the cutter sharpener includes a ridge support member and at least one sharpening means secured to the support member, the cutter sharpener being positioned within the handle member near the first cutting edge of the handle member, the cutter sharpener being biased in a substantially upward direction towards the cutter, wherein the cutter sharpener abrasively contacts the cutter as the cutter is extended and retracted from and into the handle member, the contact between the cutter and the cutter sharpener maintaining the cutter in a substantially sharpened configuration.

11. The combination tool of claim 8, wherein the rasp includes a rasp housing secured to the second rasping end of the handle member.

12. The combination tool of claim 11, further comprising a removable rasping blade secured to the rasp housing.

13. The combination tool of claim 11, wherein the rasp housing includes vanes for deflecting particles removed by the rasp away from the rasp housing, the vanes being positioned substantially behind the rasp and being affixed to the rasp housing.

14. The combination apparatus of claim 11, wherein the rasp housing is asymmetric about the handle member, the extend to which the rasp housing extends below the handle member being greater than the extent to which the rasp housing extends above the handle member.

15. A combination tool for cutting and rasping, comprising:

a. a handle member configured to be securely grasped by a user, the handle member having a first cutting end, and a second rasping end, the first cutting end and the second rasping end being positioned opposite one another at either end of the handle member;

b. a cutter secured to the first cutting end of the handle member, the cutter being used for scoring and cutting material;

c. a rasp housing secured to the second rasping end of the handle member the rasp housing being asymmetrically configured about the handle member, the rasp housing extending below the handle member a distance greater than the distance that the rasp housing extends above the handle member, the extension of the rasp housing below the handle member protecting the user's hands; and d. a rasp secured to the rasp housing, the rasp being used for smoothing, filing and finishing material.

16. The combination tool of claim 15, wherein the rasp and the rasp housing are secured to the handle member such that the user's grip remains the same as the user interchanges between using the cutter and the rasp.

* * * * *